US006315216B1

(12) United States Patent
Boecking

(10) Patent No.: US 6,315,216 B1
(45) Date of Patent: Nov. 13, 2001

(54) INJECTOR COMPRISING A PIEZO MULTILAYER ACTUATOR FOR INJECTION SYSTEMS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,023

(22) PCT Filed: Jan. 26, 2000

(86) PCT No.: PCT/DE00/00214

§ 371 Date: Dec. 15, 2000

§ 102(e) Date: Dec. 15, 2000

(87) PCT Pub. No.: WO00/47887

PCT Pub. Date: Aug. 17, 2000

(30) Foreign Application Priority Data

Feb. 10, 1999 (DE) ..... 199 05 413

(51) Int. Cl.[7] ..... B05B 1/08

(52) U.S. Cl. ..... 239/102.2; 239/584; 239/600; 251/129.06; 310/328

(58) Field of Search ..... 239/102.2, 124, 239/583, 584, 600; 251/129.06; 310/328

(56) References Cited

U.S. PATENT DOCUMENTS

| | | | |
|---|---|---|---|
| 4,471,256 | 9/1984 | Igashira et al. | 310/328 |
| 4,750,706 | 6/1988 | Schlagmuller | 251/129.06 |
| 4,803,393 | 2/1989 | Takahashi | 310/328 |
| 5,004,945 | 4/1991 | Tomita et al. | 310/328 |
| 5,094,429 | 3/1992 | Dostert | 239/102.2 X |
| 5,248,087 | 9/1993 | Dressler | 239/102.2 |
| 6,085,990 | 7/2000 | Augustin | 239/584 X |

FOREIGN PATENT DOCUMENTS

| | | |
|---|---|---|
| 4036287-A | 5/1991 | (DE) . |
| 19548526-A | 7/1997 | (DE) . |
| 19650900-A | 6/1998 | (DE) . |

*Primary Examiner*—Steven J. Ganey
(74) *Attorney, Agent, or Firm*—Ronald E. Greigg

(57) ABSTRACT

An injector having a multilayer piezoelectric actuator for injection systems, in particular for common rail diesel injection systems, of motor vehicles, in which the body of the piezoelectric actuator has a square or rectangular cross-sectional contour and is seated, together with a two-legged prestressing bracket that is mounted along opposed outer sides of the actuator body, inside a longitudinal bore of the injector body. The longitudinal bore has a polygonal cross-sectional shape with rounded corners, the shape is adapted to the cross-sectional contour of the actuator body and the prestressing bracket, so that outside the longitudinal bore, space is created in the injector body for a high-pressure bore located parallel to the longitudinal bore of the injector.

20 Claims, 2 Drawing Sheets

INJECTOR COMPRISING A PIEZO MULTILAYER ACTUATOR FOR INJECTION SYSTEMS

PRIOR ART

The invention is based on an injector having a multilayer piezoelectric actuator for injection systems, in particular for common rail diesel injection systems, of motor vehicles. The body of the piezoelectric actuator has a square or rectangular cross-sectional contour and is seated, together with a two-legged prestressing bracket that is mounted along opposed outer sides of the actuator body, inside a longitudinal bore of the injector body. One such injector is known from German Patent DE 40 36 287 C2, for instance.

FIGS. 1A and 1B, in a schematic longitudinal section A and a cross section B, schematically show one such injector, in which inside an injector body 2, an actuator forming a multilayer piezoelectric body 1 is fastened resiliently, by means of two clamping brackets the two clamping brackets are embodied as spring bands 3*a,* 3*b,* between their opposed face ends, in order to actuate a tappet (not shown) of the injector. The square actuator body 1 is seated in a cylindrical longitudinal bore 5 of the injector body 2.

As the schematic cross-sectional view in FIG. 1B shows, electrodes and contact paths 4 are mounted on the long sides of the actuator body 1. The long sides of the actuator body 1 that are used for contacting purposes are the ones along which the clamping brackets 3*a*, 3*b* do not lead.

It is known that piezoelectric actuators, as shown in FIG. 1B, can be made most economically in rectangular or square form. This is because the actuator bodies are produced in large panels and are then sawn apart at the end into individual actuators. Where a common rail injector has a short structural shape, with a rectangular or square piezoelectric actuator of this kind, the smallest possible outside diameter of the injector body in the cylinder head of an internal combustion engine is important. Typical outside diameters are about 19 to 21 mm. The actuator body, together with its prestressing bracket, the electrode contacting, and a high-pressure bore (not shown in FIGS. 1A and 1B) leading to the injector nozzle, must be accommodated within this diameter.

OBJECT AND ADVANTAGES OF THE INVENTION

It is an object of the invention to embody an injector of this generic type such that a powerful rectangular or square multilayer piezoelectric actuator, its prestressing brackets, and the high-pressure bore, can be accommodated in space-saving fashion inside an injector body having the aforementioned outside diameter.

According to the invention, by means of a rectangular or square inside bore with rounded corners, the actuator body of square or rectangular outer contour can be surrounded, together with its prestressing brackets, relatively closely by the inside bore of the injector body, and at the same time structural space for the high-pressure bore in the injector body is created.

In one exemplary embodiment, the high-pressure bore is located in the injector body along one of the sides of the actuator body, on which side there is no leg of the prestressing bracket. Furthermore, an oil leakage bore can be located opposite the high-pressure bore in the injector body, axially parallel to the longitudinal axis of the injector body.

It is important that the actuator body need not be square but can instead have a rectangular cross-sectional contour. In that case, the two legs of the prestressing bracket can extend along the two longer sides of the rectangle of the actuator body, in which case the contact paths are located on the other two sides, that is, the short sides of the rectangle, of the actuator body.

Alternatively, the internal longitudinal bore of the injector body can be designed such that both the legs of the prestressing bracket and the contact paths extend along the same sides of the rectangle of the actuator body.

Since the width of the legs of the prestressing bracket, measured perpendicular to the direction of the longitudinal axis of the injector body, can be less than the width of the associated sides of the actuator body, the cross-sectional shape of the inner longitudinal bore in the injector body can also be rounded, in such a way that two side walls of approximately circular cross section adjoin two parallel side walls of the internal longitudinal bore. This bore can likewise be produced by reaming, using a reaming tool, or by electrochemical erosion.

Various embodiments and variants of the injector of the invention are described in further detail below in conjunction with the drawing.

DESCRIPTION OF THE EXEMPLARY EMBODIMENTS

Figure 1A:
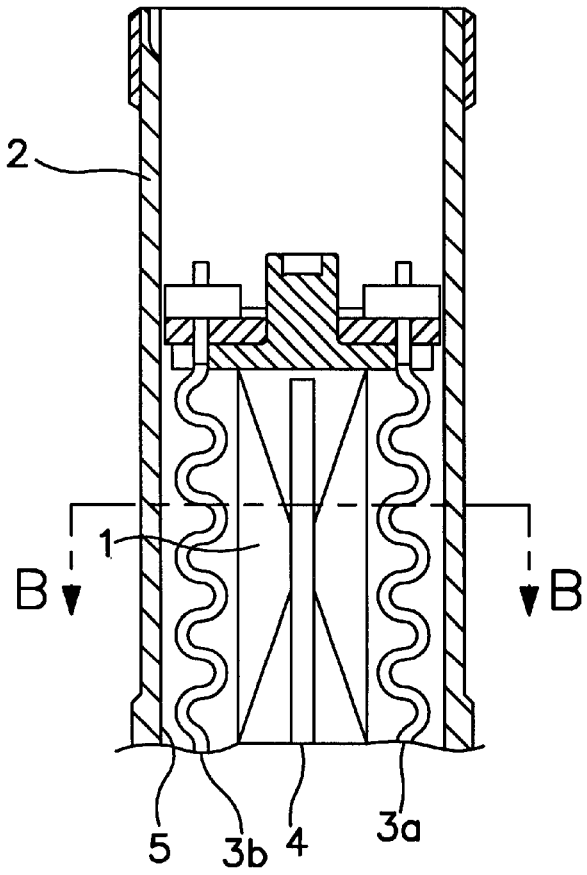
FIG. 1A PRIOR ART
FIGS. 1A and 1B show the known injector, already described above, whose injector body has a circular-cylindrical internal longitudinal bore.
Figure 1B:
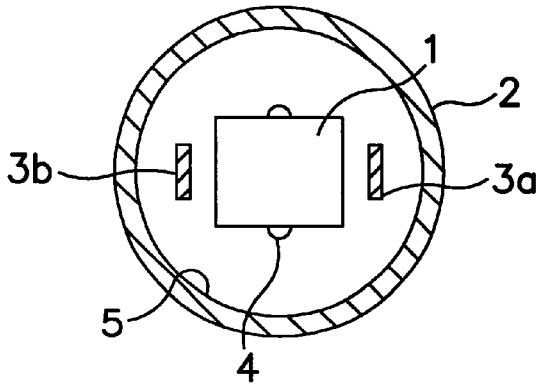
FIG. 1B PRIOR ART
Figure 2:
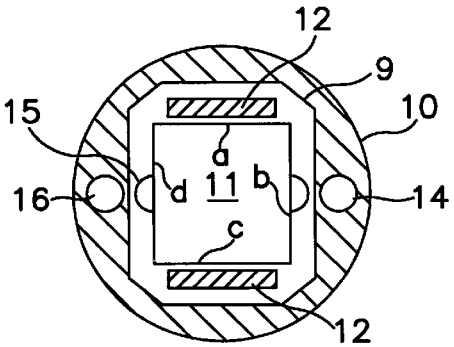
FIGS. 2–6, each in cross section, schematically show a central portion of an injector according to the invention, with variously embodied actuator bodies and variously disposed prestressing brackets.

The first exemplary embodiment, shown schematically in the form of a cross section in FIG. 2, of the injector of the invention contains a multilayer piezoelectric actuator, inside a rectangular longitudinal bore 9 with rounded corners in an injector body 10; the body 11 of this piezoelectric actuator, in the cross section shown, has a square outer contour with sides a, b, c and d.

Protruding along sides a and c are prestressing brackets 12, which fasten the actuator body 11 between its face ends (not visible in the drawing). The cross-sectional contour of the internal longitudinal bore 9 of the injector body 10 is selected such that on the other, opposed sides b and d of the rectangle of the actuator body 11, space for contact ribs 15 in the injector body outside the internal longitudinal bore 9 space still remains for a high-pressure bore 14 and an opposed oil leakage bore 16; both bores face the sides b and d of the actuator body 11 and extend in the direction of the longitudinal axis of the injector body.

Figure 3:
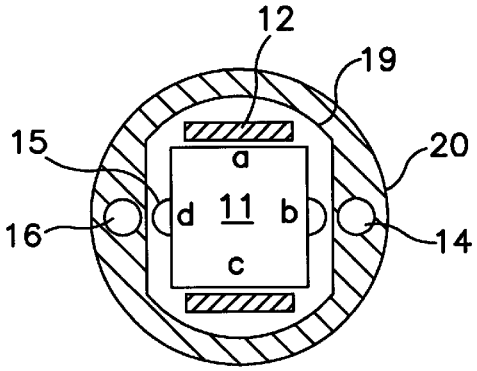

In the second embodiment of an injector of the invention as well, shown in cross section in FIG. 3, a square actuator body 11 is seated inside a rounded rectangular internal longitudinal bore 19 of an injector body 20. The location of the opposed legs 12 of the prestressing bracket, the contact ribs 15, the high-pressure bore 14 and the oil leakage bore 16 is the same as in FIG. 2. However, the cross-sectional contour of the internal longitudinal bore 19 in the injector body 20 is different from FIG. 2, because the two parallel sides of the rectangle are joined by two sides of curved cross section, especially circular sides, and the two circular sides can extend concentrically to the outer contour of the injector body 20.

Figure 4:
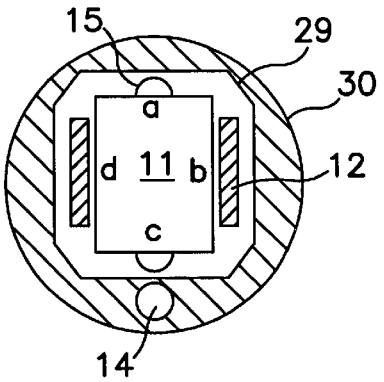

The third exemplary embodiment, shown in cross section in FIG. 4, of an injector of the invention has not a square but a markedly rectangular actuator body 11, and the opposed legs of the prestressing bracket 12 extend along the longer sides (in cross section) b and d of the rectangle of the actuator body 11. The high-pressure bore 14 and the oil leakage bore 16 and the contact ribs 15 all extend along the shorter sides a and c of the rectangle of the actuator body 11.

Figure 5:
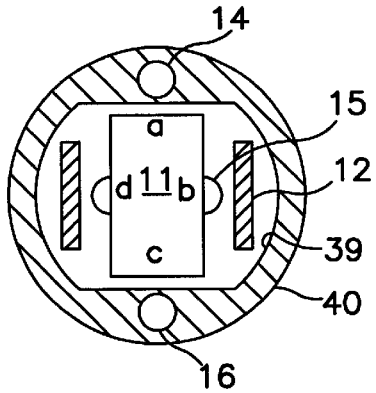

In the fourth exemplary embodiment shown in FIG. 5, the cross-sectional contour of the internal longitudinal bore 39 of an injector body 40 again has a shape of the kind already provided in the second exemplary embodiment of FIG. 3. The two legs of the prestressing bracket 12 and both contact ribs 15 extend along the longer sides b and d (in cross section) of the rectangle of the actuator body 11, which as in FIG. 4 is not square but rectangular. The high-pressure bore 14 and the oil leakage bore 16 extend along the shorter sides a and c (in cross section) of the rectangle of the actuator body 11.

Figure 6:
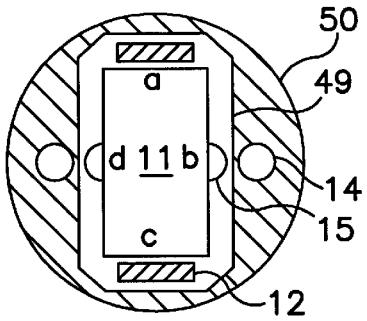

The disposition of the legs of the prestressing bracket 12, as well as of the contact ribs 15 and the high-pressure bore 14 and the oil leakage bore 16, inside an injector body 50 are the same in the fifth exemplary embodiment shown in FIG. 6 as in FIG. 2, except that in the exemplary embodiment of FIG. 2 the actuator body 11 has a square cross section, while in the exemplary embodiment of FIG. 6 the actuator body has a markedly rectangular cross section. The cross-sectional shape of the internal longitudinal bore 49 in the injector body 50 shown in FIG. 6 is therefore markedly rectangular as well, so that the injector body 50 itself offers sufficient space for the two bores, namely the high-pressure bore 14 and the oil leakage bore 16.

Figure 7:
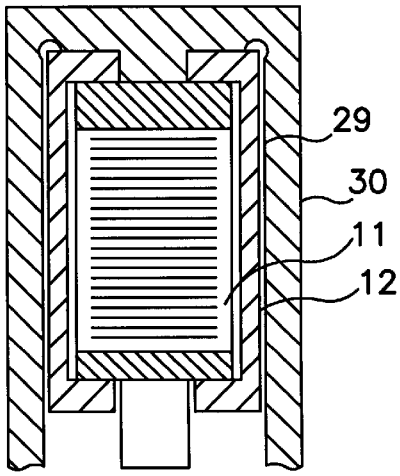
FIG. 7 shows a longitudinal section through the embodiment of an injector as shown in FIG. 4.

FIG. 7, finally, in longitudinal section shows the exemplary embodiment, shown in cross section in FIG. 4, of an injector of the invention. The contact ribs 15 are located one upstream and one downstream of the actuator body 11, as are the oil leakage bore and the high-pressure bore, so that those are not visible in FIG. 7. FIG. 7 clearly shows the location and function of the prestressing brackets, which keep the two face ends of the actuator body under initial tension.

It is important that, as the exemplary embodiments shown in FIGS. 5–7 illustrate, the actuator body need not be square.

Advantageously, the above-described common rail injector of the invention makes a short structural form of the actuator possible, while at the same time optimizing the space requirement of the injector inside the cylinder head of an internal combustion. With the use of an economically produced rectangular or square actuator and by the rounded cross-sectional contour of the internal longitudinal bore of the injector body, space can additionally be created for the high-pressure bore located in the injector body as well as for the oil leakage bore.

The foregoing relates to a preferred exemplary embodiments of the invention, it being understood that other variants and embodiments thereof are possible within the spirit and scope of the invention, the latter being defined by the appended claims.

What is claimed is:

1. An injector comprising a multilayer piezoelectric actuator for injection systems of common rail diesel fuel injection systems of motor vehicles, in which the body of the piezoelectric actuator (11) has a square or rectangular cross-sectional contour and is seated, together with a two-legged prestressing bracket that is mounted along opposed outer sides of the actuator body (11), inside a longitudinal bore (9; 19; 29; 39; 49) of the injector body (10; 20; 30; 40; 50), the longitudinal bore (9; 19; 29; 39; 49) has a polygonal cross-sectional shape with rounded corners, the shape is adapted to the cross-sectional contour of the actuator body and the prestressing bracket, so that outside the longitudinal bore, space is created in the injector body for a high-pressure bore (14) located parallel to the longitudinal bore of the injector.

2. The injector of claim 1, in which the high-pressure bore (14) is located in the injector body on one side of the actuator body (11), on the one side there is no leg of the prestressing bracket (12).

3. The injector of claim 2, in which an oil leakage bore (16) opposite the high-pressure bore also extends in the injector body (10) parallel to an axis of the injector body.

4. The injector of claim 3, in which the cross-sectional contour of the actuator body is not square but rectangular.

5. The injector of claim 4, in which the two legs of the prestressing bracket (12) extend along the two longer sides of the rectangle of the actuator body (11).

6. The injector of claim 4, in which the two legs of the prestressing bracket extend along the two shorter sides of the rectangle of the actuator body (11).

7. The injector of claim 2, in which the cross-sectional contour of the actuator body is not square but rectangular.

8. The injector of claim 7, in which the two legs of the prestressing bracket (12) extend along the two longer sides of the rectangle of the actuator body (11).

9. The injector of claim 7, in which the two legs of the prestressing bracket extend along the two shorter sides of the rectangle of the actuator body (11).

10. The injector of claim 2, in which the width of the legs of the prestressing bracket (12), measured in a direction perpendicular to the longitudinal axis of the injector body, is less than the width of the associated side of the actuator body (11).

11. The injector of claim 2, in which the longitudinal bore (9; 19; 29; 39; 49) of the injector body is produced by reaming or electrochemical erosion.

12. The injector of claim 1, in which an oil leakage bore (16) opposite the high-pressure bore also extends in the injector body (10) parallel to an axis of the injector body.

13. The injector of claim 12, in which the cross-sectional contour of the actuator body is not square but rectangular.

14. The injector of claim 13, in which the two legs of the prestressing bracket (12) extend along the two longer sides of the rectangle of the actuator body (11).

15. The injector of claim 13, in which the two legs of the prestressing bracket extend along the two shorter sides of the rectangle of the actuator body (11).

16. The injector of claim 1, in which the cross-sectional contour of the actuator body is not square but rectangular.

17. The injector of claim 16, in which the two o legs of the prestressing bracket (12) extend along the two longer sides of the rectangle of the actuator body (11).

18. The injector of claim 16, in which the two legs of the prestressing bracket extend along the two shorter sides of the rectangle of the actuator body (11).

19. The injector of claim 1, in which the width of the legs of the prestressing bracket (12), measured in a direction perpendicular to the longitudinal axis of the injector body, is less than the width of the associated side of the actuator body (11).

20. The injector of claim 1, in which the longitudinal bore (9; 19; 29; 39; 49) of the injector body is produced by reaming or electrochemical erosion.

* * * * *

UNITED STATES PATENT AND TRADEMARK OFFICE

CERTIFICATE OF CORRECTION

PATENT NO. : 6,315,216 B1
DATED : November 13, 2001
INVENTOR(S) : Friedrich Boecking It is certified that error appears in the above-identified patent and that said Letters Patent is hereby corrected as shown below:

Title page,
Item [54], should read as follows,
-- [54] INJECTOR WITH MULTILAYER PIEZOELECTRIC ACTUATOR FOR INJECTION SYSTEMS --

Signed and Sealed this

Fourteenth Day of May, 2002

*Attest:*

*Attesting Officer*

JAMES E. ROGAN
*Director of the United States Patent and Trademark Office*